United States Patent [19]

Hasegawa et al.

[11] 4,405,911

[45] Sep. 20, 1983

[54] ELECTROMAGNETIC RELAY

[75] Inventors: Hiroshi Hasegawa; Moriyasu Negita; Yoshiaki Kamiya; Masaru Tamura; Masaru Tamura; Yuji Kinoshita, all of Suzaka, Japan

[73] Assignee: Fujitsu Limited, Kawasaki, Japan

[21] Appl. No.: 304,904

[22] Filed: Sep. 23, 1981

[30] Foreign Application Priority Data

Sep. 26, 1980 [JP] Japan ..... 55-133733

[51] Int. Cl.[3] ..... H01H 50/04

[52] U.S. Cl. ..... 335/202; 335/135

[58] Field of Search ..... 335/129, 135, 202

[56] References Cited

U.S. PATENT DOCUMENTS 3,548,200 12/1970 Coffin, Jr. ..... 335/135

3,668,578 6/1972 Schroeder ..... 335/202

4,101,856 7/1978 Durr ..... 335/202

*Primary Examiner*—Harold Broome

*Attorney, Agent, or Firm*—Staas & Halsey

[57] ABSTRACT

An electromagnetic relay comprising a box-shaped relay case having an upper opening for accommodating therein an electromagnet, a group of resilient contacts and an operation card, and a relay cover for covering the case. The relay case and cover comprise insulated partition walls for separating the electromagnet from the group of resilient contacts. The partition walls are integrally formed with the relay case and the relay cover respectively, and overlap each other when the relay cover is engaged with the relay case. The use of the partition walls provides for an increased withstand voltage for the electromagnetic relay. In addition, the relay has a coil with grooved coil bobbins capable of receiving coil terminals in such a way that the electromagnetic relay may be mounted either in a direction parallel or perpendicular to the base of the relay case.

13 Claims, 13 Drawing Figures

ELECTROMAGNETIC RELAY

BACKGROUND OF THE INVENTION

1. Field of the Invention

The present invention relates to an electromagnetic relay, and more particularly to a compact and low cost electromagnetic relay having a high withstand voltage and a simple structure.

2. Description of the Prior Art

Known compact electromagnetic relays usually comprise an electromagnet including a coil, a core and an armature, a group of resilient contacts including holding contacts and movable contacts, and an operation card which transmits the motion of the armature to the resilient contacts. In such electromagnetic relays, it is possible to energize the electromagnet by a relatively small current by using, for example, a transistor switching circuit, thereby making or breaking electric contacts between the holding contacts and the movable contacts in order to handle electric currents having a relatively large current and potential.

However, since the above-mentioned conventional relays do not have a partition between the electromagnet and the group of resilient contacts, the withstand voltage between the electromagnet and the group of resilient contacts cannot be large and, therefore, conventional compact relays cannot handle electric signals having large potentials.

SUMMARY OF THE INVENTION

It is the principal object of the present invention to provide a new and improved electromagnetic relay of a small size having a large withstand voltage.

It is another object of the present invention to provide an electromagnetic relay having a relatively simple structure and a low cost.

It is still another object of the present invention to provide an electromagnetic relay which uses a small number of component parts and which can easily be manufactured.

According to the present invention, there is provided an electromagnetic relay comprising a box-shaped relay case made of insulating materials which has an upper opening, and which accommodates therein an electromagnet containing at least a coil, a core and an armature, a group of resilient contacts including holding resilient contacts and movable resilient contacts, and an operation card for transmitting pivoting force of the armature to the movable resilient contacts in order to make or break electrical contact between the holding resilient contacts and the movable resilient contacts, the electromagnetic relay further comprising a relay cover for covering the upper opening of said relay case, wherein both the relay case and the relay cover comprise a partition wall for partitioning the electromagnet from the group of resilient contacts, and which is formed integrally of the relay case and the relay cover and is located on the inner side of the relay cover, both partition walls overlapping each other when the relay cover is engaged with the relay case.

DESCRIPTION OF THE PREFERRED EMBODIMENTS

Figure 1:
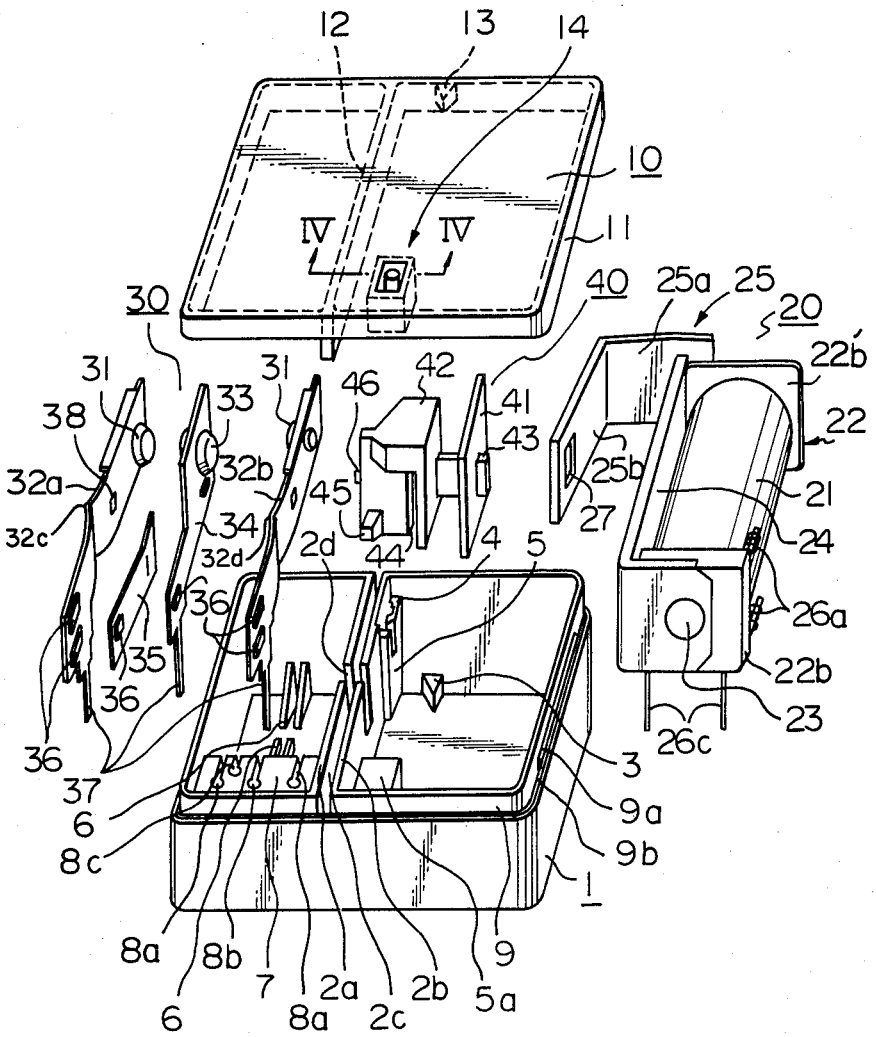
FIG. 1 is an exploded perspective view illustrating the component parts of an electromagnetic relay according to the present invention.
Figure 2:
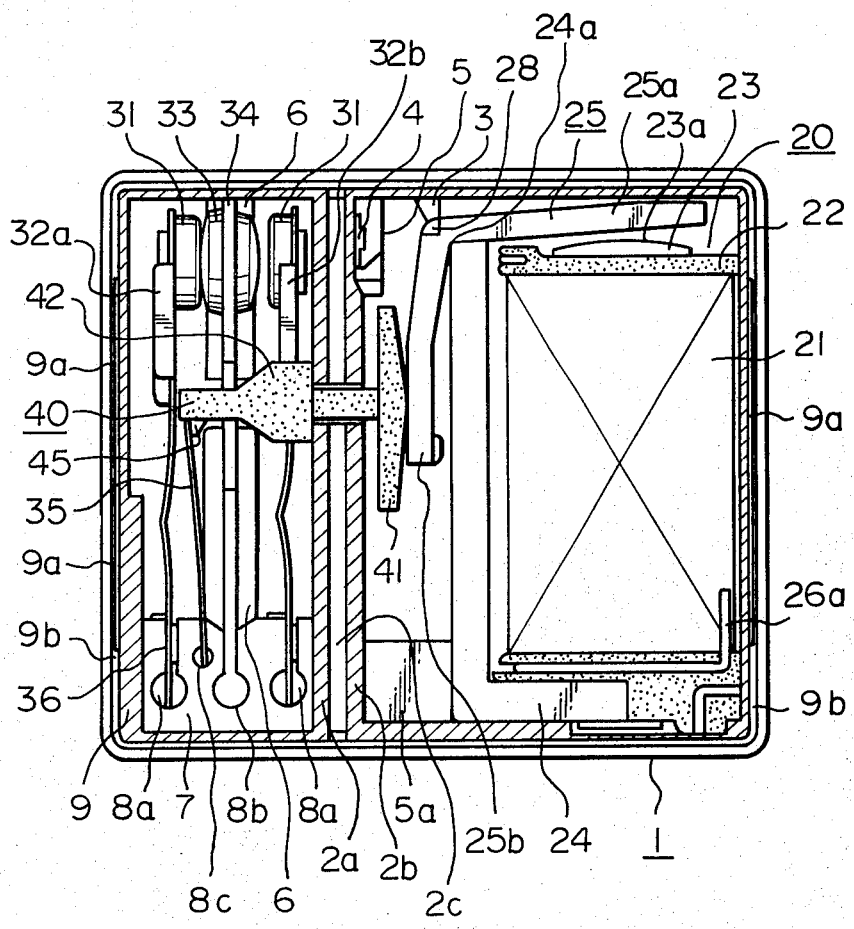
FIG. 2 is a plan view illustrating an electromagnetic relay in the release condition according to the present invention.

With reference to the attached drawings, the present invention will now be explained. As illustrated in FIG. 1 and FIG. 2, an electromagnetic relay of an embodiment of the present invention comprises a box-shaped relay case 1 which is molded out of insulating resin, a molded relay cover 10 of insulating resin, an electromagnet 20, a group of resilient contacts 30 and an operation card 40 made of insulating resin.

The relay case 1 has partition walls **2*a* and 2*b* therein which are formed integrally with the relay case 1 and which partition the inner space of the relay case 1 into a space for accommodating the electromagnet 20 and a space for accommodating the group of the resilient contacts 30. Formed integrally with the base of the relay case 1, in the space for the electromagnet 20, is a projection 3, which supports an armature 25 in a floating condition between the base of the relay case 1 and the relay cover 10. At the inner wall of the space for the electromagnet 20 and on the partition wall 2*b*, a projection 5 having a groove 4, into which an armature holding spring 50 (shown in FIGS. 7 and 8) is inserted, is formed integrally with the relay case 1. Also in the space for the electromagnet 20, a projection 5*a* is integrally formed with the relay case 1 so that the electromagnet 20 can be held between the projection 5*a* and the inner surface of the relay case 1**.

In the space for the group of the resilient contacts 30, projections 6, which support a holding resilient contact 34, and a support 7 for holding the group of the resilient contacts 30, are integrally formed with the relay case 1 respectively at the base and an inner wall thereof. The support 7 has slots **8*a*, 8*b* and 8*c*, which are open to the inner side of the space for the group of the resilient contacts 30**, and which slots have enlarged circular portion at the outer side ends thereof.

Between and along the partition walls 2a and 2b, a slot 2c is formed, and in a direction perpendicular to the partition walls 2a and 2b, there is formed a cut-away portion 2d into which the operation card 40 is slidably inserted.

Figure 3:
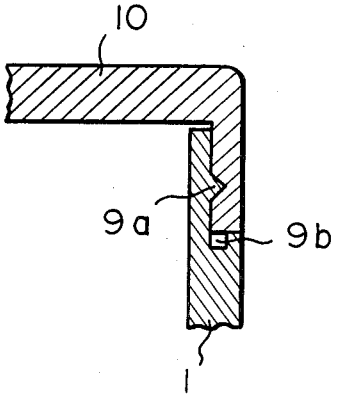
FIG. 3 is a cross sectional view illustrating a coupling state of the edges of a relay case and a relay cover.

As also illustrated in detail in FIG. 3, the relay case 1 has projections 9a which are formed on the outer side of upper peripheral walls 9 of the relay case 1 and by which the relay cover 10 and the relay case 1 are tightly coupled. The relay case 1 also has a groove 9b which is formed on an upper edge of lower peripheral walls of the relay case 1 and which is used as a pool of an adhesive agent for fixing the relay cover 10 to the relay case 1.

Figure 4:
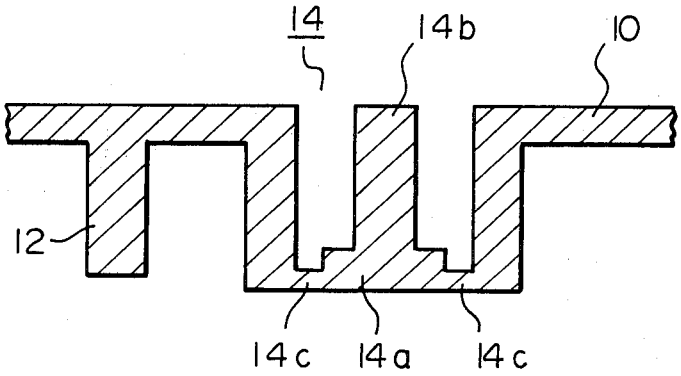
FIG. 4 is a cross sectional view illustrating a ventilation pipe used in the relay cover of the electromagnetic relay according to the present invention.

As illustrated in FIGS. 1 and 2, the relay cover 10 has a peripheral wall 11 which fits on the outside of the upper peripheral wall 9 of the relay case 1, and has grooves which are formed on the inner surface of the peripheral wall 11 and which fit on the corresponding projections 9a of the relay case 1. At the inner side of the relay cover 10, there is integrally formed with the relay cover 10 a partition wall 12, which is inserted into the slot 2c between the partition walls 2a and 2b of the relay case 1, and a projection 13, which corresponds to the projection 3 of the relay case 1 and which similarly supports together with the projection 3 the armature 25. Also at the inner side of the relay cover 10, in the space for the electromagnet 20 of the relay case 1, there is a ventilation pipe 14 integrally formed with the relay cover 10, as illustrated in detail in FIG. 4. The tip portion of the ventilation pipe 14 is closed by a lid portion 14a having a bar portion 14b. The peripheral portion 14c of the lid portion 14a is thin. Once the relay cover 10 is attached to the relay case 1 and the electromagnetic relay is washed by using washing fluid after the electromagnetic relay is mounted on a printed circuit board, the lid portion 14a and the bar portion 14b are broken off at the thin peripheral portion 14c of the lid portion 14a by using a tool which can grip the bar portion 14b. After the lid portion 14a and the bar portion 14b are removed, the ventilation pipe 14 operates to dissipate heat generated by the coil 21 of the electromagnet 20.

Figure 5A:
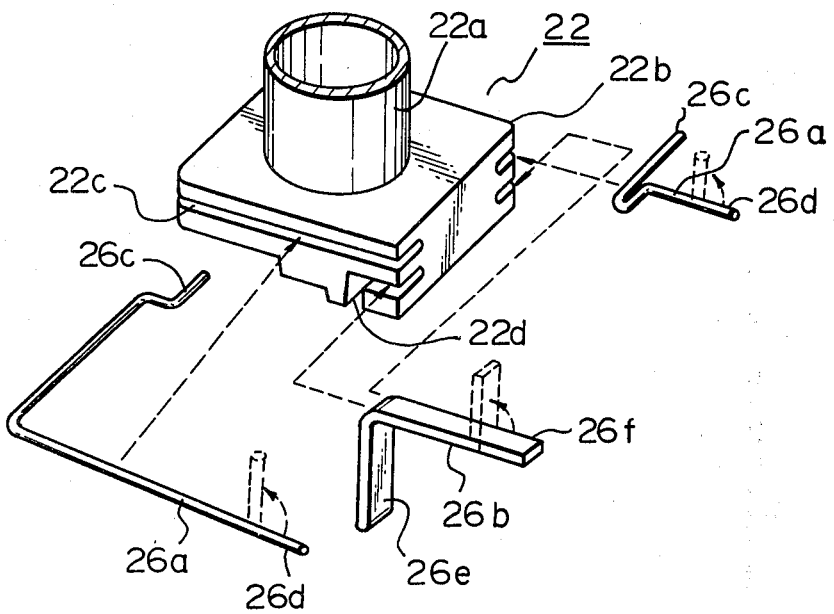
FIG. 5A is an exploded perspective view illustrating a coil bobbin and its terminal connections as used in an electromagnetic relay according to the present invention.

The electromagnet 20 comprises a coil 21, a coil bobbin 22 on which the coil 21 is wound, a core 23, an L-shaped yoke 24 to which is attached the core 23, and, an armature 25 approximately having an L-shape. The coil bobbin 22 has, as also illustrated in FIG. 5A, a cylinder portion 22a and square shaped flange portions 22b and 22b', each of which are integrally formed with the cylinder portion 22a at both ends thereof. A pair of coil terminals 26a are attached to one of the flange portions, such as flange portion 22b. An external connecting terminal 26c of each of the coil terminals 26a extends in a direction perpendicular to the coil 21 and is drawn out from the base of the relay case 1.

As illustrated in FIG. 5A, the flange portion 22b has a first groove 22c, which is formed continuously on three peripheral edges of the flange portion 22b, and in which the coil terminals 26a are inserted when the electromagnet 20 is mounted in a parallel direction to the base of the relay case 1. The flange portion 22b has also second grooves 22d, each of which has an L-shape constituted by a parallel groove portion to the first groove 22c and a perpendicular groove portion to the parallel portion, and in which the coil terminals 26b are inserted when the electromagnet 20 is mounted in a direction perpendicular to the base of the relay case. Therefore, the coil bobbin 22 mentioned above can be used in both an electromagnetic relay in which the electromagnet is mounted in a direction parallel to the base of the relay case and in an electromagnetic relay in which the electromagnet is mounted in a direction perpendicular to the base of the relay case, a configuration not shown in the drawings.

Figure 5B:
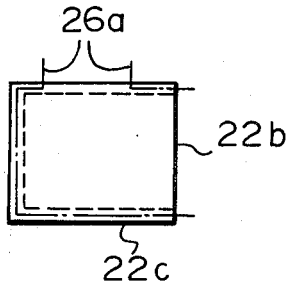
FIG. 5B is a schematic plan view illustrating a coil bobbin of FIG. 5A.

When the electromagnet 20 is mounted in a direction parallel to the base of the relay case 1 as illustrated in FIGS. 1 and 2, a pair of coil terminals 26a made from L-shaped metal bars are inserted into the first groove 22c as also illustrated in FIG. 5B and fixed by adhesive agent. Each of the end portions 26c of the coil terminals 26a constitutes an external connecting terminal which is drawn out from the base of the relay case 1, and each of the other end portions 26d of the coil terminals 26a constitutes an internal connecting terminal to which a coil lead from the coil 21 is connected. When the electromagnet is mounted in a direction perpendicular to the base of the relay case, a pair of coil terminals 26b made from L-shaped long and narrow metal plates are inserted into the second grooves 22d and fixed by an adhesive agent. Each of the end portions 26e of the coil terminals 26b constitutes an external connecting terminal which is drawn out from the base of the relay case, and each of the other end portions 26f constitutes an internal connecting terminal to which a coil lead from the coil is connected. Both of the internal connecting terminals 26d and 26f of the coil terminals 26a and 26b are bent perpendicularly as illustrated by dotted lines in FIG. 5A in order to decrease the size of the electromagnet.

Figure 5C:
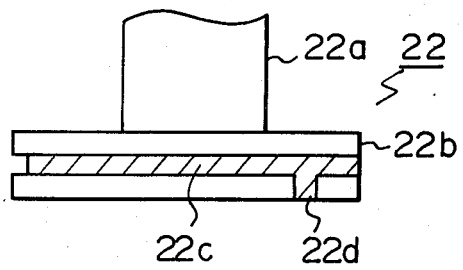
FIG. 5C is a schematic partial elevational view illustrating another example of a coil bobbin used in an electromagnetic relay according to the present invention.

FIG. 5C illustrates an alternate embodiment of the flange portion 22b of the coil bobbin 22. In the flange portion 22b of FIG. 5C, a groove corresponding to the first groove 22c of the flange portion 22b of FIG. 5A and a groove corresponding to the second groove 22d of the flange portion 22b of FIG. 5A are communicated to each other to form a T-shaped groove. Therefore, the thickness of the flange portion 22b can be decreased, and, since the internal connecting terminals 26d and 26f of both coil terminals 26a and 26b are attached to the same positions of the flange portion 22b, the winding of the coil can be effected by the same winding machine in the manufacturing process of both the electromagnet mounted parallel to the base of the relay case and the electromagnet mounted perpendicular to the base of the relay case.

Figure 6:
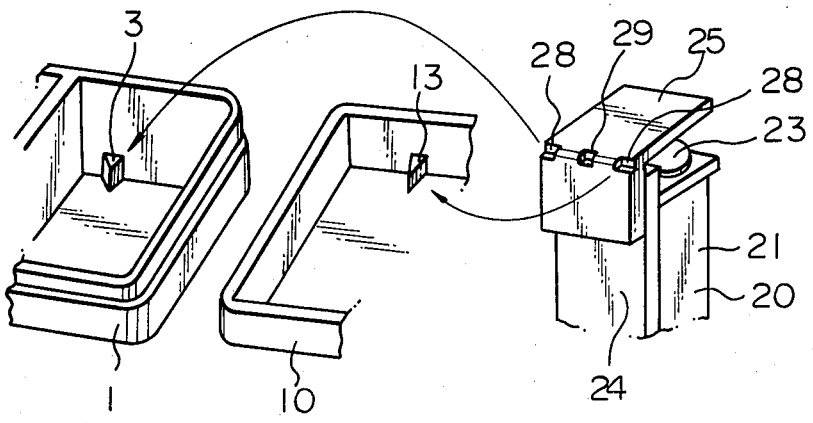
FIG. 6 is a perspective view illustrating the assembly of an electromagnet between a relay case and a relay cover.

The armature 25 has an opening 27 into which a projection 43 of the operation card 40 is inserted and which is formed at one of the arm portions 25b of the armature 25. As illustrated in detail in FIG. 6, at the outer surface of the bent corner portion of the armature 25, are formed depressions 28 which are coupled to the projections 3 and 13 of the relay case 1 and the relay cover 10, and, a depression 29 to which an end of the armature holding spring 50 is coupled.

The group of the resilient contacts 30 comprises: a pair of movable resilient contacts 32a and 32b, each of which is made from a thin resilient metal plate having a contact member 31; a holding resilient contact 34, which is made of thick metal plate having a holding contact member 33, and which is disposed between the movable resilient contacts 32a and 32b; and a release leaf spring 35 disposed between the movable resilient contact 32a and the holding resilient contact 34. Since the release leaf spring 35 is disposed between the holding resilient contact 34 and the movable resilient contact 32*a*, the width of the group of the resilient contacts can be small so that the electromagnetic relay can be compact. At the rear end of each of the resilient contacts 32*a*, 32*b*, 34 and 35, one or more raised portions 36, which are projected outwardly from the surface of each of the resilient contacts 32*a*, 32*b*, 34 and 35, are formed in order to tightly fix the resilient contacts by the slots 8*a*, 8*b* and 8*c* of the support base 7. Each of the resilient contacts 32*a*, 32*b* and 34 has a connecting terminal portion 37 which is drawn out from the base of the relay case 1 and which is formed integrally with each of the resilient contacts 32*a*, 32*b* and 34. Each of the movable resilient contacts 32*a* and 32*b* have a bent portion, 32*c* and 32*d* respectively, by which the resilient contacts 32*a* and 32*b* are disposed toward the electromagnet 20. Therefore, if the resilient force caused by the resilient contacts 32*a* and 32*b* is strong, it is also possible to omit the release leaf spring 35.

The operation card 40 comprises a pair of closing plate portions 41 and 42, which are parallel to each other and, which are disposed on both sides of the partition walls 2*a* and 2*b* so as to alternatively cover the openings 2*d* of the partition walls 2*a* and 2*b*. On the outer surface of the closing plate portion 41 is formed a projection 43 which is inserted into the opening 27 of the armature 25. On the outer side of the other closing plate portion 42 is: a slot 44 into which is inserted the resilient contact 32*b*; a projection 45 to which the tip of the release leaf spring 35 is engaged; and a projection 46 which is inserted into an opening 38 of the movable resilient contact 32*a* . Slot 44 and projections 45 and 46 are integrally formed with the operation card 40.

Figure 7:
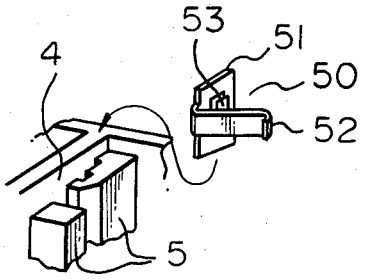
FIG. 7 is a perspective view illustrating the assembly of an armature holding spring into a relay case.
Figure 8:
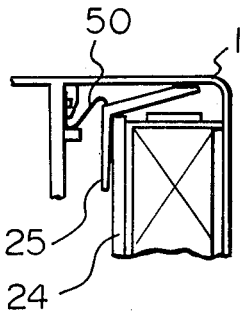
FIG. 8 is a plan view illustrating a part of an electromagnetic relay according to the present invention including an armature and an armature holding spring.

The aforementioned relay is assembled as follows. Before the electromagnet 20 is put into the relay case 1, the armature holding spring 50 is inserted into the groove 4 of the projection 5 formed in the relay case 1, as illustrated in FIG. 7. The armature holding spring 50 has a base plate portion 51 and a tongue portion 52 which extends at an acute angle with the surface of the base plate portion 51. The base plate portion 51 has a spring-like hook 53 for engaging with the groove 4 of the projection 5. After the armature holding spring 50 is inserted into the groove 4 of the projection 5, the electromagnet 20 is inserted into the space for the electromagnet 20 of the relay case 1 in a direction parallel to the base of the relay case 1 so that the electromagnet 20 is tightly held between the projection 5*a* and the inner wall of the relay case 1, and so that the armature 25 can pivot above the base of the relay case 1 as also illustrated in FIG. 8. In this case, one of the depressions 28 of the armature 25 is engaged with the projection 3 of the relay case 1, and the other depression 28 of the armature 25 is coupled with the projection 13 of the relay cover 10 when the relay cover 10 is attached to the relay case 1. In addition the tip of the tongue portion 52 of the armature holding spring 50 is engaged into the depression 29 of the armature 25.

After the above-mentioned assembling is effected, the armature 25 is supported by the projections 3 and 13 in a floating condition between the base of the relay case 1 and the relay case 10, and the inner corner of the L-shaped armature 25 is pressed on the top edge 24*a* (see FIG. 2) of the yoke 24 by the armature holding spring 50, so that the armature 25 can pivot with stability.

Figure 9:
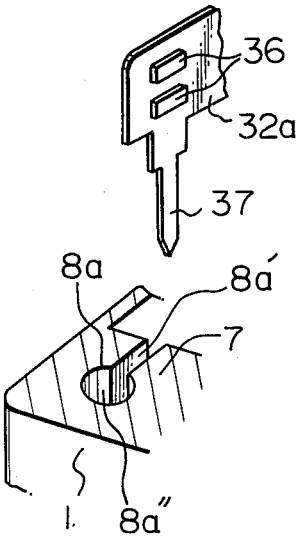
FIGS. 9 and 10 are perspective views illustrating alternate embodiments for attaching a resilient contact to a support base of a relay case; and, FIG. 11 is a cross sectional view illustrating an engaged condition of the partition walls of the relay case and the relay cover.

The assembling of the group of the resilient contacts 30 is effected as follows. Each of the resilient members 32*a*, 32*b*, 34 and 35 is attached to the support 7 of the relay case 1 so that each resilient member extends in a direction parallel to the base of the relay case 1. For example, as illustrated in FIG. 9, the movable resilient contact 32*a* is attached to the support 7 so that the connecting terminal 37 is drawn out from the base of the relay case 1 and the rear end of the movable resilient contact 32*a* is tightly inserted into the slot 8*a*. The other resilient members 32*b*, 34 and 35 are attached to the support 7 in a similar manner to that of the movable resilient contact 32*a*. As illustrated in FIGS. 2 and 9, the raised portion 36 of the resilient member 32*a* (or 32*b*, 34 or 35) is inserted into a thin slot portion 8*a'* of the slot 8*a* and helps to effect a solid coupling of the resilient member 32*a* and the support 7. The enlarged circular portion 8*a''* of the slot 8*a* is used as a pool for an adhesive agent which tightly fixes the resilient member 32*a* to the support 7.

Figure 10:
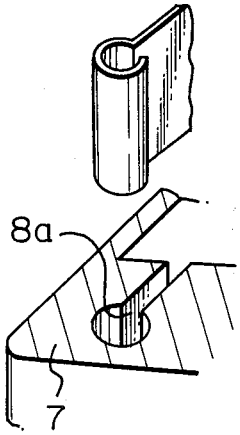

As illustrated in FIG. 10, it is also possible to form a cylindrical portion at the rear end of each of the resilient members 32*a*, 32*b*, 34 and 35 which is inserted into the enlarged circular portion 8*a''*, in order to prevent the resilient member from coming off the slot 8*a*.

After the electromagnet 20 and the group of the resilient contacts 30 are attached to the relay case 1, the operation card 40 is slidably inserted into the openings 2*d* of the partition walls 2*a* and 2*b* so that the closing plate portions 41 and 42 are disposed on both sides of the partition walls 2*a* and 2*b*. The projections 43 and 46 of the operation card 40 are respectively inserted into the opening 27 of the armature 25 and the opening 38 of the movable resilient contact 32*a*. The movable resilient contact 32*b* comes into the slot 44 of the operation card 40 and a tip portion of the release leaf spring 35 is engaged to the projection 45 of the operation card 40. Since the width of the holding resilient contact 34 is narrow except for the tip portion where the contact metal member 33 is attached, the operation card 40 can be positioned over the narrow portion of the holding resilient contact 34 and can slide freely without being interrupted by the holding resilient contact 34.

Figure 11:
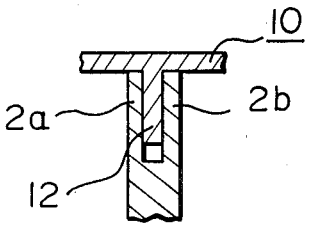

The assembling of the electromagnetic relay according to the present invention is finished by covering the upper opening of the relay case 1 with the relay cover 10 in such a manner that the partition wall 12 of the relay cover 10 is inserted into the slot 2*c* between the partition walls 2*a* and 2*b* of the relay case 1 as illustrated in detail in FIG. 11, and that the projection 13 of the relay cover 10 is engaged with the depression 28 of the armature 25.

The operation of the electromagnetic relay according to the present invention will now be explained. In a release condition as illustrated in FIG. 2, the operation card 40 is pushed by the release leaf spring 35 toward the electromagnet 20 so that the closing plate 42 shuts the opening 2*d*. In this condition, the movable resilient contact 32*a* and the holding resilient contact 34 are in electrical contact with each other because the movable resilient contact 32*a* is disposed toward the holding resilient contact 34 by its own resiliency. Since the movable resilient contact 32*b* is disposed in a direction away from the holding resilient contact 34 by its own resiliency, and the operation card 40 is pushed toward the electromagnet 20 by the release leaf spring 35, the movable resilient contact 32*b* and the holding resilient contact 34 are out of electrical contact with each other.

When the electromagnet 20 is energized by the supply of electrical current to the coil 21, one of the arms 25*a* of the armature 25 is attracted to the top surface 23*a* of the core 23 until it abuts the surface 23*a*. The armature pivots about the base of the relay case 1 upon the tip edge 24*a* of the yoke 24, and the other arm 25*b* of the armature 25 moves toward the group of the resilient contacts 30. Therefore, the operation card 40 is forced to slide toward the group of the resilient contacts 30, and the opening 2*d* of the partition walls 2*a* and 2*b* is closed by the closing plate 41. The operation card 40 then moves against the force of the release leaf spring 35 to further move the movable resilient contacts 32*a* and 32*b* away from the electromagnet 20. Therefore, the movable resilient contact 32*b* and the holding resilient contact 34 come into electrical contact with each other, and the movable resilient contact 32*a* and the holding resilient contact 34 come out of electrical contact with each other.

When the electromagnet 20 is again de-energized, the operation card 40 is moved by the resilient force of the movable resilient contacts 32*a* and 32*b* and the release leaf spring 35 toward the electromagnet 20 and the electromagnetic relay again comes into the release condition illustrated in FIG. 2.

As mentioned above, in the electromagnetic relay according to the present invention, the partition walls 2*a*, 2*b* and 12, which are integrally formed with the relay case 1 and the relay cover 10 respectively, and which overlap each other when they are combined, are formed in the relay case 1 and in the inner side of the relay cover 10 respectively in order to partition the electromagnet 20 from the group of resilient contacts 30. By employing the partition, the insulation distance between the electromagnet 20 and the group of the resilient contacts 30 can be increased, and therefore, the withstand voltage of the electromagnetic relay can be correspondingly increased.

Since the operation card 40 comprises the closing plate portions 41 and 42 for closing the opening 2*d* of the partition walls 2*a* and 2*b* when the electromagnetic relay is in the operated condition and in the released condition respectively, the insulation distance between the electromagnet 20 and the group of the resilient contacts can be increased so that the withstand voltage can be correspondingly increased.

Since the projections 3 and 13 for supporting the armature 25, and the projection 5 for attaching the armature holding spring 50, are integrally formed with the relay case 1 and the relay cover 10, the number of the component parts of the electromagnetic relay is decreased from that used in the prior art, and since the electromagnet 20, the group of resilient contacts 30 and the operation card 40 can be mounted in the relay case 1 from the upper opening thereof, the assembling of the electromagnetic relay is made easier than previously known.

When the electromagnet 20 and the resilient contacts are mounted in a direction parallel to the base of the relay case 1 as illustrated in FIGS. 1 and 2, the height of the electromagnetic relay can be very small and it is then capable of being mounted on a printed circuit board.

Therefore, according to the present invention, there is provided a compact and inexpensive electromagnetic relay using higher withstand voltage than previously possible.

We claim:

1. An electromagnetic relay comprising: a box-shaped relay case having an upper opening which is made of insulating material and which accommodates therein an electromagnet including at least a coil, a core and an armature, a group of resilient contacts, including holding resilient contacts and movable resilient contacts, and an operation card for transmitting a pivoting force of said armature to said movable resilient contacts in order to make or break electrical contact between said holding resilient contacts and said movable resilient contacts; and a relay cover which covers said upper opening of said relay case, wherein both said relay case and said relay cover have a partition wall for partitioning said electromagnet from said group of resilient contacts, said partition walls being formed integrally with said relay case and said relay cover on the inner sides of said relay case and said relay cover, and each partition wall overlapping the other when said relay cover is engaged with said relay case.

2. An electromagnetic relay of claim 1, wherein one of said partition walls has a slot formed on an edge of said one of the partition walls and the other one of said partition walls is inserted into said slot when said relay cover engages said relay case.

3. An electromagnetic relay of claim 1, wherein at least one of said partition walls has an opening which is formed in a direction substantially perpendicular to said partition walls and into which said operation card is slidably inserted, and said operation card has at least one closing plate portion, which is disposed on the side of said electromagnet in said relay case, and which closes said opening of said partition walls when said armature pivots toward said partition walls.

4. An electromagnetic relay of claim 3, wherein said operation card comprises closing plate portions disposed on both sides of said partition walls, one of said closing plate portions closing said opening of said partition walls in a release condition of said electromagnetic relay, and another one of said closing plate portions closing said opening of said partition walls in an operated condition of said electromagnetic relay.

5. An electromagnetic relay of claim 4, wherein said relay case and said relay cover further comprise a pair of projections which are respectively formed integrally with said relay case and said relay cover, and wherein said armature is L-shaped and has a pair of depressions formed on the outside bent corner of said L-shaped armature which are engaged with said pair of projections respectively.

6. An electromagnetic relay of claim 4, further comprising an armature holding spring, and wherein said relay case has a projection which is formed integrally with said relay case and which has a groove for fixing said armature holding spring to said relay case, and wherein said armature is L-shaped and has a depression formed on the outside bent corner of said L-shaped armature which is engaged to the end portion of said armature holding spring.

7. An electromagnetic relay of claim 6, wherein said relay case has a support base which is formed integrally with said relay case and which has a plurality of slots each accommodating a resilient contact of said group of resilient contacts, and wherein each of said slots of said support base has an enlarged portion at an outer side end thereof for receiving a corresponding portion of said resilient contacts.

8. An electromagnetic relay of claim 4, wherein said group of resilient contacts further comprises a release leaf spring disposed between said holding resilient contact and said movable resilient contact.

9. An electromagnetic relay of claim 8, wherein said operation card comprises a projection which is disposed on a side wall thereof and which is engaged with an end of said release leaf spring.

10. An electromagnetic relay of claim 1, wherein said relay cover has one or more ventilation pipes each having a lid portion which can be removed after the manufacturing of said electromagnetic relay is finished.

11. An electromagnetic relay of claim 1, wherein said relay case has edge portions, and wherein one or more grooves are formed on the edge portions which are engaged with said relay cover.

12. An electromagnetic relay of claim 1, wherein said coil of said electromagnet comprises a coil bobbin having a cylinder portion and square shaped flange portions, one of said square-shaped flange portions having first grooves which are formed along and on peripheral edges of said flange portion and which accommodate coil terminals whose end portions extend in a direction perpendicular to said cylinder portion of said coil bobbin, and second L-shaped grooves which are constituted by groove portions formed parallel to said first grooves and groove portions formed perpendicular to said first grooves and which accommodate coil terminals whose end portions extend in a direction parallel to said cylinder portion of said coil bobbin, said coil bobbin being able to be mounted on the base of said relay case in a direction parallel to the base of said relay case or in a direction perpendicular to the base of said relay case.

13. An electromagnetic relay of claim 1, wherein said coil of said electromagnet comprises a coil bobbin having a cylinder portion and square-shaped flange portions, one of said square-shaped flange portions having a single T-shaped groove formed along and on peripheral edges of said flange portion capable of accommodating both coil terminals whose end portions extend in a direction perpendicular to said cylinder portion of said coil bobbin, and coil terminals whose end portions extend in a direction parallel to said cylinder portion of said coil bobbin, said coil bobbin being capable of being mounted on the base of said relay case in a direction parallel or perpendicular to the base of said relay case.

* * * * *

UNITED STATES PATENT AND TRADEMARK OFFICE

CERTIFICATE OF CORRECTION

PATENT NO. : 4,405,911

DATED : September 20, 1983

INVENTOR(S) : Hiroshi Hasegawa; Moriyasu Negita; Yoshiaki Kamiya; Masaru Tamura; Yuji Kinoshita It is certified that error appears in the above-identified patent and that said Letters Patent is hereby corrected as shown below:

Inventors:

Line 2, delete "Masaru Tamura".

Col. 3, line 2, "portion" should be --portions--.

Signed and Sealed this

*Seventeenth* Day of *January 1984*

[SEAL]

*Attest:*

*Attesting Officer*

GERALD J. MOSSINGHOFF

*Commissioner of Patents and Trademarks*

UNITED STATES PATENT AND TRADEMARK OFFICE

CERTIFICATE OF CORRECTION

PATENT NO. : 4,405,911

DATED : 9/20/83

INVENTOR(S) : HASEGAWA ET AL.

It is certified that error appears in the above-identified patent and that said Letters Patent is hereby corrected as shown below:

(30) FOREIGN APPLICATION PRIORITY DATA

"55-133733" s/b --55-133773--.

Signed and Sealed this

*Twenty-second* Day of *January 1985*

[SEAL]

*Attest:*

DONALD J. QUIGG

*Attesting Officer* *Acting Commissioner of Patents and Trademarks*